United States Patent [19]

Byers

[11] 4,238,897

[45] Dec. 16, 1980

[54] TWO FACED DISPLAY HOLDER

[75] Inventor: Thomas L. Byers, Del City, Okla.

[73] Assignee: Central Sales Promotions, Inc., Oklahoma City, Okla.

[21] Appl. No.: 891,523

[22] Filed: Mar. 30, 1978

[51] Int. Cl.[3] ..... G09F 3/18

[52] U.S. Cl. ..... 40/16.2

[58] Field of Search ..... 40/16, 16.2, 16.4, 1.5, 40/10, 5, 1.6, 124.2, 158 R

[56] References Cited

U.S. PATENT DOCUMENTS

| | | | |
|---|---|---|---|
| 1,658,573 | 2/1928 | Roper et al. | 40/1.5 |
| 1,715,238 | 5/1929 | Kleschka | 40/1.6 |
| 2,437,415 | 3/1948 | Berry | 40/124.2 |
| 2,645,867 | 7/1953 | Sternberg | 40/5 |
| 2,736,976 | 3/1956 | Richthammer | 40/158 R |
| 2,895,241 | 7/1959 | Ferdinand et al. | 40/16.2 |
| 3,344,543 | 10/1967 | Griffin et al. | 40/1.5 |
| 3,387,397 | 6/1968 | Buchanan et al. | 40/10 R |
| 3,942,273 | 3/1976 | Adams | 40/1.5 |

FOREIGN PATENT DOCUMENTS

| | | | |
|---|---|---|---|
| 6405339 | 11/1964 | Netherlands | 40/16.2 |
| 223245 | 11/1942 | Switzerland | 40/1.5 |

*Primary Examiner*—Gene Mancene
*Assistant Examiner*—Wenceslao J. Contreras
*Attorney, Agent, or Firm*—Allegretti, Newitt, Witcoff & McAndrews

[57] ABSTRACT

Apparatus for presenting a display utilized with a placard preferably includes a first display member and a second display member that each define a channel for slidably receiving and retaining an object of visual observation. The display members are releasably connected in a back-to-back relationship by cooperative connector portions integrally defined on the back surfaces thereof. Preferably, a recess is defined in each channel for receiving a flap on the object of visual observation, and a ridge protrudes into the channel to engage the object and facilitate its removal.

9 Claims, 7 Drawing Figures

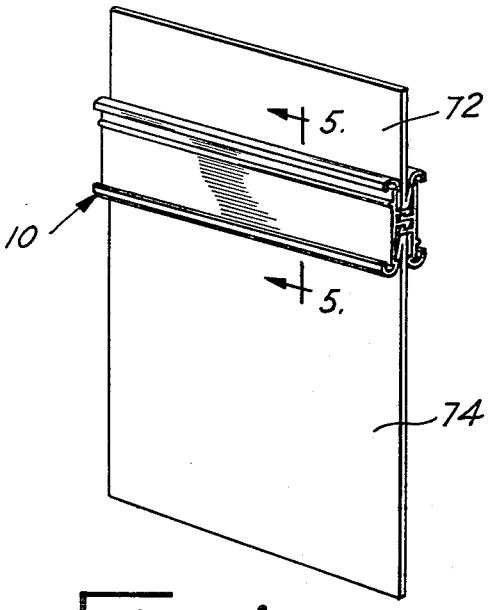
Fig. 4
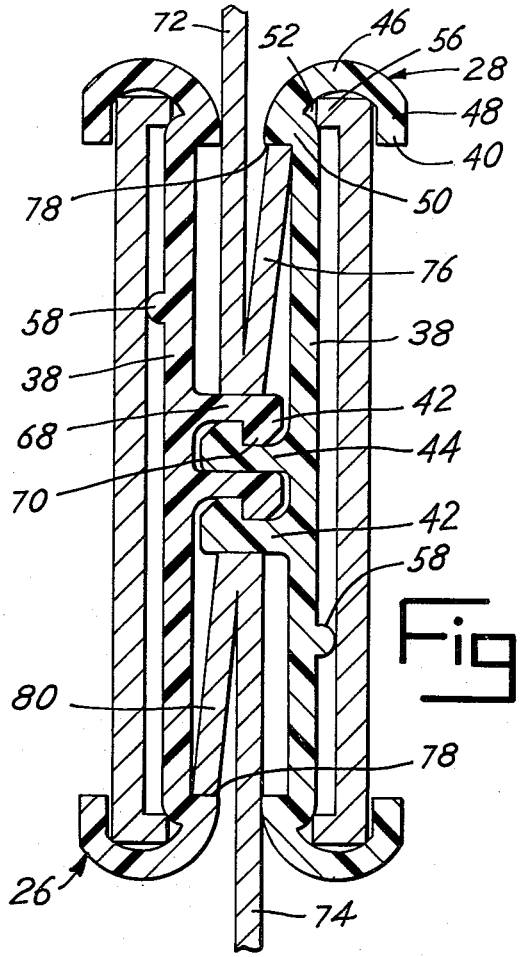
Fig. 5
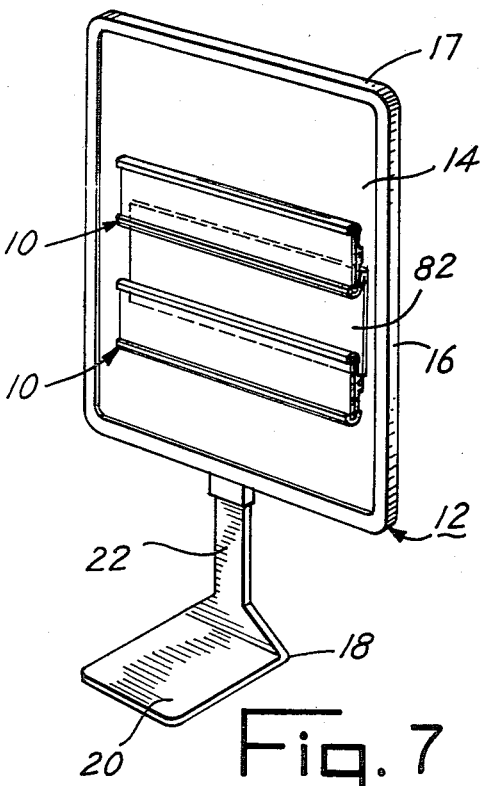
Fig. 7
Fig. 6
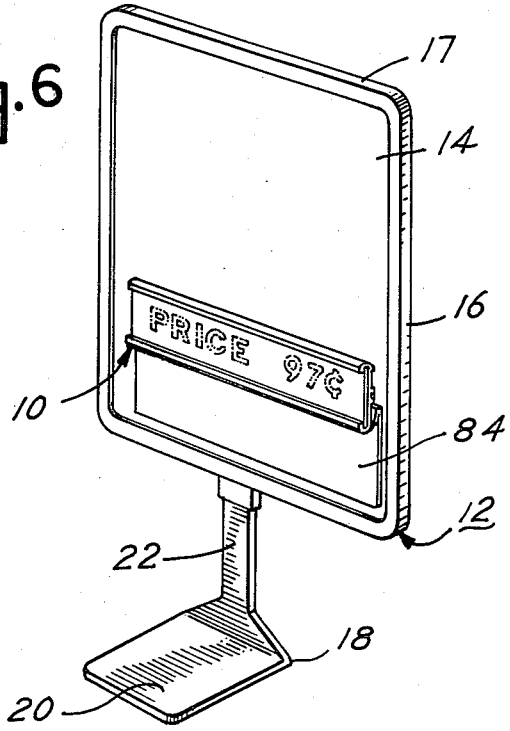

TWO FACED DISPLAY HOLDER

BACKGROUND OF THE INVENTION

This invention relates to apparatus for presenting displays and more particularly, to a display member and apparatus including a first and a second display member which cooperatively define connector means for releasably connecting each other in a back-to-back relationship.

In the past, a variety of display devices, such as index tabs and snap-on price tag holders, have been disclosed in U.S. Patents. Those patents known to the inventor are U.S. Pat. Nos. 2,125,264 entitled "Index Strip Holder" and issued Aug. 2, 1938 to G. J. Aigner; 2,623,311 entitled "Self-Attaching Index Tab" and issued Dec. 30, 1952 to J. C. Condon; 3,073,046 entitled "Index Tabs" and issued Jan. 15, 1963 to J. C. Condon; 3,196,564 entitled "Guide Tab" and issued July 27, 1965 to H. W. Boedeker; 3,220,125 entitled "Display Devices and Mounting Means Therefor" and issued Nov. 30, 1965 to A. H. Wende; 3,220,127 entitled "Game Score Display Device" and issued Nov. 30, 1969 to H. B. Wilson; 3,469,813 entitled "Snap-On Support for Price Tag Holder" and issued Sept. 30, 1969 to V. Rizze; 3,540,140 entitled "Foldable Label Holder" and issued Nov. 17, 1970 to R. Tourre; and 3,846,925 entitled "Frame Means" and issued Nov. 12, 1974 to R. Busse. Among these patents, those issued to Aigner, Boedeker, Wende, Wilson, Rizzi and Busse disclose channel-shaped display holders, and those issued to Condon and Tourre disclose foldable, self-attaching index holders.

SUMMARY OF THE INVENTION

While the display devices thus described well suit their intended functions, it is a principal object of the present invention to provide apparatus for presenting a display that has a first and a second display member which are releasably connectable in a back-to-back relationship. Another object of the present invention is to provide a display member which defines a channel for slidably receiving and snugly retaining a feature card on which featured sale prices or the like can be printed. Another object is to provide connector means, for display members positioned in a back-to-back relationship, which are not exposed to visual observation or physical damage, as are metal clips, nuts and bolts, and similar fasteners.

A further object of the present invention is to provide apparatus usable with a display stand that supports a placard. Another object is to provide apparatus which extends the useful life of the placard by permitting easy and neat variation of temporarily featured sale prices and the like. Another object is to provide an apparatus which permits the desired feature variation while maintaining the advantage of a slidably removable placard.

These and other objects and advantages are satisfied by the present invention, which, in a principal aspect, is apparatus for presenting a display that includes a first display member and a second display member. The first display member has a first back surface and display means for receiving and retaining an object of visual observation. The second display member has a second back surface. Together, the first display member and the second display member cooperate to define means for releasably connecting the first display member and the second display member in a connected position. The first back surface and the second back surface are substantially adjacent in the connected position.

Preferably, the display members each define a channel for slidably receiving and snugly retaining an object of visual observation. Also, as preferred, the connecting means includes a first connector portion and a second connector portion integrally formed on the first display member and a mating connector portion integrally formed on the second display member, the mating connector portion being retained between the first connector portion and the second connector portion when the display members are in the connected position.

Most preferred is the preferred embodiment of the invention, the objects and advantages of which, in addition to those stated, will become apparent from the description of the preferred embodiment of the invention, which follows.

BRIEF DESCRIPTION OF THE DRAWING

The preferred embodiment of the invention will be described in connection with the drawing wherein:

FIG. 4 is a perspective view of the preferred embodiment, as utilized with a hanging display card;

FIG. 5 is an enlarged, partial, cross-sectional view taken along line 5—5 of FIG. 4;

FIG. 6 is a perspective view of similar to FIG. 1; and

FIG. 7 is a perspective view similar to FIG. 6.

DESCRIPTION OF THE PREFERRED EMBODIMENT

Figure 1:
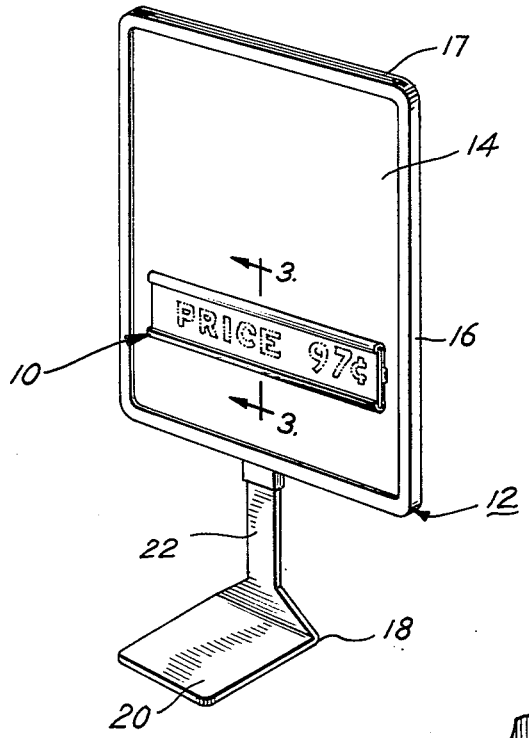
FIG. 1 is a perspective view of the preferred embodiment of the present invention, as utilized with a display stand.

Referring to FIG. 1, the preferred embodiment of the present invention is shown and generally designated as apparatus 10 incorporated into a free-standing, countertop display stand 12, which is used for advertising.

As an aid to illustration of the apparatus 10, the display stand 12 includes a rectangular metal frame 16 that supports and frames a planar placard 14 made of cardboard or other similar material. Each of the four unitary portions or sides of the frame 16 is U-shaped in cross-section, and the spaced, parallel flanges of the sides extend inward toward the center of the frame 16 to retain the placard 14. A slot 17 is defined in the top portion of the frame 16 for removing the placard 14.

A base member 18, also formed of metal, supports the frame 16. A horizontal, planar foot 20 thereof stabilizes an integrally formed upright post 22 on which the frame 16 is removably fastened. When placed on a countertop, the display stand 12 thus elevates the placard 14 and the apparatus 10 to a prominent position at eye-level, for viewing from all directions. Because both sides of the placard 14 may be seen, advertising copy is printed on both sides thereof.

Figure 2:
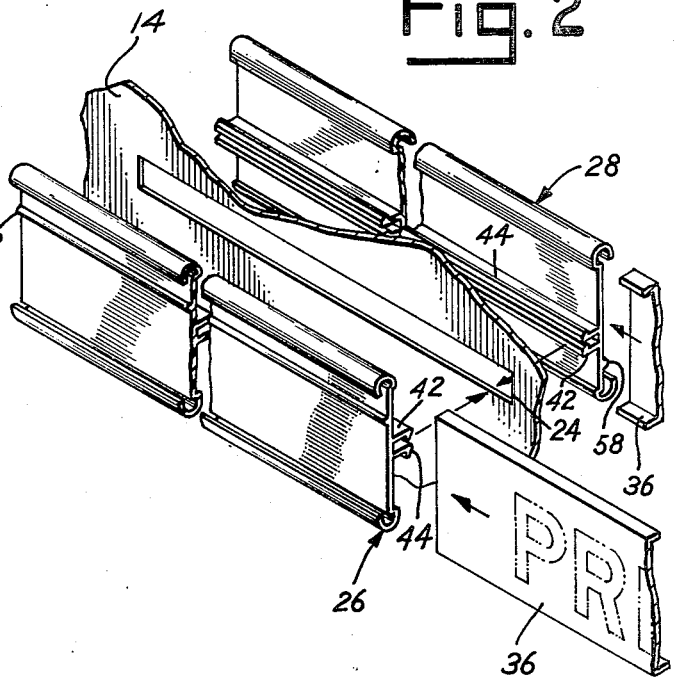
FIG. 2 is a partial, exploded, perspective view of the preferred embodiment.

Turning to the apparatus 10, as best shown in FIG. 2, the placard 14 defines a horizontally elongated, rectangular slot 24 through which a first display member 26 and a second display member 28 are connectable. Each display member 26,28 defines a channel, and into each channel a rectangular, horizontally elongated feature card 36 is positioned as will be described. The display members 26,28 are releasably connected to one another, and thus, the feature cards 36 may be individually replaced, or the display members 26,28 may be temporarily removed and the placard 14 replaced in the frame 16.

Figure 3:
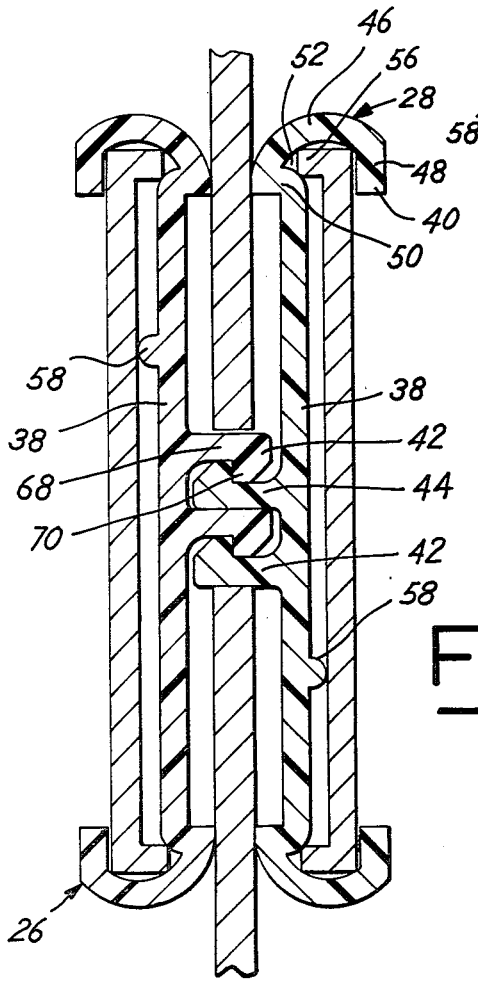
FIG. 3 is an enlarged, partial, cross-sectional view taken along line 3—3 of FIG. 1.

Referring now to FIG. 3, the display members 26,28 are shown in cross-section as connected through the placard 14, with the feature cards 36 in position. The display members 26,28 have a uniform cross-section throughout their lengths, and as can be seen by comparing them in FIG. 3, they are identical, as preferred. The display members 26,28 thus can be cut from a common stock that is extruded from polypropylene, or a similar flexible material.

As detailed in FIG. 3, the display members 26,28 each include a substantially planar wall portion 38 that is substantially parallel to the placard 14. Formed on the back, or placard facing surface, of the wall portion 38 are a first and a second connector portion 42,44; formed on the front surface is a ridge 58; and formed along the top and bottom are identical edge portions 40.

Each edge portion 40 includes an arcuate section 46 and a planar section 48. The arcuate section 46 curves inward toward the center of the wall member 38 and has an arcuate length of approximately 135 degrees. The planar section 48 extends inward from the forward end of the arcuate section 46 and lies in a plane parallel to the wall portion 38.

At the juncture between the arcuate section 46 and the wall portion 38, a 90 degree angle backbend 50 is formed. The backbend 50 and the arcuate section 46 define a recess 52 in the channel, which extends from the front surface of the wall portion 38 to a depth substantially equal to the thickness of the wall portion 38. The recess 52 serves to receive a turned-back edge 56 of the feature card 36, and the feature card 36 may be snugly retained by wedging the front of the feature card 36 against the planar section 48 and the turned-back edge 56 in the recess 52. The ridge 58 of each display member 26, 28 is rounded and protrudes into the channel formed by each display member 26, 28. The ridge 58 lifts the feature card 56 off the front surface of the wall portion 38 and thus facilitates sliding removal movement of the feature card 36 in the channel, when desired, while exerting pressure against the feature card 36 to retain it under other circumstances.

The connector portions 42, 44 of each display member 26, 28 are each L-shaped and each include a flexible post section 68 and an arm section 70. The post section 68 extends outward perpendicularly from the back surface of the wall portion 38, and the arm sections 70 on each display member 26, 28 are angled in one and the same direction perpendicularly from the outer end of the post section 68. In the plane of the wall portion 38, each post section 68 and each arm section 70 has a preselected width, and the two post sections 68 on each display member 26, 28 are separated by the width of the arm section 70 while the arm sections 70 are separated by the width of the post section 68. In a plane perpendicular to that of the wall portion 38, the arm sections 70 are separated from the wall portion 38 by a distance greater than the height of the arm sections 70. Once the display members 26, 28 are cut from common stock, one display member must be turned upside-down in relation to the other so that their arm sections 70 extend in opposite directions, and the display members 26, 28 can be pressed together, as shown in FIG. 3. When the display members 26, 28 are pressed together, the post sections 70 of the connector portions 42, 44 of the first display member 26 flex, as do the "mating" post sections 70 of the "mating" connector portions 42, 44 of the second display member 28. This flexing permits the arm sections 70 of each display member to pass or between the "mating" arm sections 70 of the other display member. To facilitate the flexing, an inclined surface is located on the outermost corner of each arm section 70.

Once the arm sections 70 pass by or between each other, the post sections 68 return to their unflexed positions. The arm sections 70 interact to lock against each other and retain the first connector portion 42 of the second display member 28 between the connector members 42, 44 of the first display member 26, and the connector portion 44 of the first display member 26 between the connector members 42, 44 of the second display member 28. The display members 26, 28 will thus remain secured in a back-to-back relationship until they are intentionally, forcibly separated.

Referring now to FIGS. 4–7, the apparatus 10 as described above is depicted as utilized in three alternative manners. As will become apparent, these three alternatives are merely illustrative of the potential uses of the apparatus 10.

As shown in FIGS. 4 and 5, the apparatus 10 may be utilized with two hanging placards 72, 74. The upper placard 72 has a turned-back flap 76 that extends in a generally upward direction and engages the ledge 78 formed atop the back surface of the wall portion 38 of the second display member 28 by the back bend 50. The lower placard 74 has a turned-back flap 80 that extends in a generally downward direction and engages the ledge 78 formed along the bottom of the first display member 26. The placard 74 is thus hung from the apparatus 10, which is hung from the placard 72.

As shown in FIGS. 6 and 7 the apparatus 10 may also be utilized in pairs on a placard 14 to hold an insert 82 therebetween, or alone on a placard 14, with a hanging placard 84 hung therefrom. The apparatus 10 thus may be utilized alone or in combination with other apparati 10 to provide a unified display of one mounted or hanging placard with one or more other mounted or hanging placards.

It should thus be clear that the objects of the invention are fully satisfied by the preferred embodiment. For example, the display members 26, 28 permit the desired variation of the feature cards 36 while maintaining the advantage of a placard 14 slidably removable through a slot 17. Further, the connector members 42, 44 are not exposed on the fronts of the display members 26, 28.

From the foregoing, it should be apparent to those having skill in the art that modification or changes could be made in the construction of the apparatus described herein. Thus, the preferred embodiment of the present invention is to be considered in all respects as illustrative and not restrictive, the scope of the invention claimed being measured by the appended claims, rather than the foregoing description. All constructions which come within the meaning and range of equivalency of the claims are intended to be embraced therein.

What is claimed is:

1. Apparatus for presenting two, opposed displays, utilized with two objects of visual observation and comprising, in combination:

an elongated first display member having a first back surface and first display means for receiving and retaining one of said objects of visual observation; and an elongated second display member having a second back surface and second display means for receiving and retaining the other of said objects of visual observation;

said first display member and said second display member co-operating to define means for releasably connecting said first and second display members in a connected position wherein said first back surface and said second back surface are substantially adjacent; and said connecting means including an elongated, L-shaped first connector portion and an elongated second connector portion integrally formed on said first display member and an elongated, L-shaped first mating connector portion and an elongated second mating connector portion integrally formed on said second display member, said first mating connector portion substantially identical to said first connector portion and said second mating connector portion substantially identical to said second connector portion, said first connector portion including a flexible first post section and an arm section, said first post section projecting outwardly from said first back surface, having an outer end and a first post section width in the plane of the first back surface, said arm section angled substantially perpendicularly from said outer end and having an arm section width in the plane of the first back surface, said second connector portion including a second flexible post section, said second flexible post section projecting outwardly from said first back surface at a distance in the plane of said first back surface from said first post section substantially equal to said arm section width and a distance from the arm section substantially equal to said first post section width, said first mating connector portion including a first flexible mating post section and a mating arm section, said mating post section projecting outwardly from said first back surface, having an outer end and a mating post section width in the plane of the second back surface substantially equal to said first post section width, said mating arm section angled substantially perpendicularly from said outer end of said mating post section and having a mating arm section width in the plane of the second back surface substantially equal to the arm section width of the arm section, and said second mating connector portion including a second flexible mating post section, said second mating post section projecting outwardly from said second back surface at a distance in the plane of said second back surface from said first mating post section substantially equal to said mating arm section width and a distance from the mating arm section substantially equal to said first mating post section width, said arm section and said mating arm section interacting for retaining said mating connector portion between said first connector portion and said second connector portion when said first display member and said second display member are in said connected position.

2. The apparatus of claim 1 wherein said arm section and said mating arm section each has an outermost corner and an inclined surface on said outermost corner for facilitating the flexing of the first post section and the second post section to allow the mating arm section to pass between the first post section and the second post section in movement to said connected position under the application of pressure perpendicular to the first back surface and the second back surface.

3. The apparatus of claim 1 wherein said arm section is a first arm section, said second post section and said second mating post section each has an outer end and said mating arm section is a first mating arm section, said second connector portion having a second arm section angled substantially perpendicularly from said outer end of said second post section and having a second arm section width in the plane of the first back surface substantially equal to the first arm section width and said second mating connector portion having a second mating arm section, said second mating arm section angled substantially perpendicularly from said outer end of said second mating post section and having a second mating arm section width in the plane of the second back surface substantially equal to the first arm section width, said second arm section and said second mating arm section interacting for retaining said second connector portion between said first mating connector portion and said second mating connector portion when said first display member and said second display member are in said connected position.

4. The apparatus of claim 3 wherein said first display member and said second display member are identical.

5. The apparatus of claim 1 wherein said display members each defines a channel for slidably receiving and retaining an object of visual observation and further defines a recess in said channel, said recess for receiving a turned-back edge on one of said objects of visual observation.

6. The apparatus of claim 1 wherein said display members each defines a channel for slidably receiving and retaining an object of visual observation and each includes a ridge that protrudes into said channel for engaging one of said objects of visual observation.

7. The apparatus of claim 1 for utilization with a placard having a flap, said first display member having a ledge along said first back surface for engaging said flap.

8. A display member for utilization with an object of visual observation and another display member of substantially identical construction, said display members having, a substantially planar, elongated wall portion including a top, a bottom, a front surface and a back surface, an elongated top edge portion joined to said wall portion along said top, an elongated bottom edge portion joined to said wall portion along said bottom, an elongated, L-shaped first connector portion joined to said wall portion along said back surface, said first connector portion including a flexible first post section and an arm section, said first post section projecting outwardly from said back surface, having an outer end and a first post section width in the plane of said back surface, and said arm section angled substantially perpendicularly from said outer end and having an arm section width in the plane of said back surface, an elongated second connector portion joined to said wall portion along said back surface adjacent said first connector portion, said second connector portion including a flexible second post section projecting outwardly from said back surface at a distance in the plane of the back surface from said first connector portion substantially equal to said arm section width and at a distance in the plane of the back surface from said arm section substantially equal to said first post section width, said top edge portion, said bottom edge portion and said front surface defining a channel for slidably receiving said object of visual observation.

9. A display member a claimed in claim 8 wherein said arm section is a first arm section and said second post section has an outer end and a width in the plane of the back surface substantially equal to the width of the first post section, said second connector portion being L-shaped and including a second arm section angled substantially perpendicularly from said outer end of said second post section and having a width in the plane of the back surface substantially equal to said arm section width, said first arm section and said second arm section being angled in the same direction.

* * * * *